United States Patent [19]

Takahashi et al.

[11] Patent Number: 4,982,714

[45] Date of Patent: Jan. 8, 1991

[54] AIR-FUEL CONTROL APPARATUS FOR AN INTERNAL COMBUSTION ENGINE

[75] Inventors: Toshihisa Takahashi; Masanobu Uchinami; Shinichi Nishida, all of Himeji; Hitoshi Inoue, Amagasaki, all of Japan

[73] Assignee: Mitsubishi Denki Kabushiki Kaisha, Tokyo, Japan

[21] Appl. No.: 515,524

[22] Filed: Apr. 30, 1990

Related U.S. Application Data

[63] Continuation of Ser. No. 227,561, Aug. 3, 1988, abandoned.

[30] Foreign Application Priority Data

Aug. 19, 1987 [JP] Japan ..... 62-126904[U]

[51] Int. Cl.[5] ..... F02D 41/14

[52] U.S. Cl. ..... 123/488; 123/489

[58] Field of Search ..... 123/440, 488, 489, 494

[56] References Cited

U.S. PATENT DOCUMENTS

| | | | |
|---|---|---|---|
| 3,867,916 | 2/1975 | Bigalke | 123/146.5 A X |
| 3,894,976 | 10/1976 | Nagai | 123/440 X |
| 4,150,562 | 4/1979 | Nielsen | 123/440 X |
| 4,534,330 | 8/1985 | Osuga et al. | 123/489 X |
| 4,546,747 | 10/1985 | Kobayashi et al. | 123/489 |
| 4,730,594 | 3/1988 | Hibino et al. | 123/589 |
| 4,732,128 | 3/1988 | Yoshioka et al. | 123/440 |
| 4,882,030 | 11/1989 | Suzuki et al. | 204/406 |

FOREIGN PATENT DOCUMENTS

| | | | |
|---|---|---|---|
| 34432 | 2/1984 | Japan | 123/488 |
| 62-30948 | 2/1987 | Japan . | |
| 62-82248 | 4/1987 | Japan . | |

*Primary Examiner*—Tony M. Argenbright

*Attorney, Agent, or Firm*—Sughrue, Mion, Zinn, Macpeak & Seas

[57] ABSTRACT

In an air-fuel ratio control apparatus for an internal combustion engine, an air-fuel ratio sensor detects an air-fuel ratio in response to specified components contained in exhaust gas and an electronic control section receives a signal from the air-fuel ratio sensor to calculate an amount of fuel to be injected from a fuel supplying device so that the air-fuel ratio of a gas mixture to be supplied to the engine approaches a target air-fuel ratio. A parameter of a load for the engine and an engine revolution number are each detected, and the electronic control section calculates a correction coefficient on the basis of the parameter of the load and the engine revolution number, whereby the output of the air-fuel ratio sensor is corrected.

4 Claims, 4 Drawing Sheets

AIR-FUEL CONTROL APPARATUS FOR AN INTERNAL COMBUSTION ENGINE

This is a continuation of patent application Ser. No. 07/227,561, filed on Aug. 3, 1988, now abandoned.

BACKGROUND OF THE INVENTION

1. FIELD OF THE INVENTION

The present invention relates to an air-fuel control apparatus for a fuel injection type internal combustion engine for an automobile.

2. DISCUSSION OF BACKGROUND

It is necessary to maintain an air-fuel ratio in exhaust gas (hereinbelow, referred to simply as an air-fuel ratio) around a theoretical air-fuel ratio in an internal combustion engine, particularly, one provided with a three-way catalytic exhaust gas purifying means. For this purpose, there has been practically used, for instance, an air-fuel ratio control apparatus which comprises an oxygen concentration sensor for detecting an air-fuel ratio on the basis of the concentration of oxygen contained in exhaust gas, an air-fuel ratio control means having an electronically-controlled fuel injection device for controlling the air-fuel ratio of a gas mixture to be supplied to the burning chamber of the engine by controlling the quantity of fuel to be injected, and an electronic control device for effecting feed-back control of a fuel injection quantity by the electronically controlled fuel injection device so that the value of the air-fuel ratio approaches the value of a theoretical air-fuel ratio in response to a calculated air-fuel ratio obtained by an output of oxygen concentration.

In the conventional air-fuel ratio control apparatus, the feed-back control was carried out so that the air-fuel ratio approaches the theoretical air-fuel ratio, whereby an exhaust gas purifying effect could be sufficiently improved by using the three catalytic system disposed in an exhaust gas discharging unit. However, although the conventional air-fuel ratio control apparatus could improve an exhaust gas purifying function, it is difficult to maintain a theoretical air-fuel ratio even under such a condition that the engine is operated in a practically allowable state and the air-fuel ratio is at a lean side, and accordingly the performance of the engine can not sufficiently be obtained. Further, the feed-back control could not be obtained when a high torque is required by rendering the air-fuel ratio to be rich in a full open state of the engine. Accordingly, a precise correction of the air fuel ratio could not be obtained when an air-fuel ratio varies in a rich region because of variation with time and the scattering in dimensional value of the parts of the engine.

In particular, the above-mentioned problem becomes serious in an internal combustion engine with a supercharger. When a predetermined air-fuel ratio in the rich region is further deviated toward a rich side, it falls in an inflammable range to thereby cause firing. On the contrary, when the predetermined air-fuel ratio is shifted toward the lean side, the temperature of the exhaust gas becomes high to thereby cause damage to the parts of the internal combustion engine.

In order to eliminate the above-mentioned problem, there has been such a proposal that an air-fuel ratio for an internal combustion engine is feed-back-controlled to give a predetermined air-fuel ratio, in addition to the control of the theoretical air-fuel ratio, by using a sensor which continuously measures an air-fuel ratio in a region covering the lean side and the rich side on the basis of specified components contained in exhaust gas (such sensor is referred to as an air-fuel ratio sensor hereinbelow).

In the air-fuel ratio control for the conventional apparatus, the information of air-fuel ratio was obtained by calculation of only an output value from the air fuel sensor, whereby the fuel supplying device is controlled to obtain a target air-fuel ratio on the basis of the calculated value of air-fuel ratio information. Accordingly, there was caused an error in the output of the air-fuel ratio sensor due to the conditions (such as the pressure, the temperature and so on) of exhaust gas around the air-fuel ratio sensor when the engine was operated, and such error reduced accuracy in the calculated air-fuel ratio information. Thus, a highly accurate air-fuel control could not be obtained over the entire operable region of the engine.

SUMMARY OF THE INVENTION

It is an object of the present invention to provide an air-fuel ratio control apparatus for an internal combustion engine capable of providing always a correct air-fuel ratio information even when the conditions of exhaust gas vary during the operation of the engine, whereby a high, fine control of air-fuel ratio can be obtained over the entire operable region of the engine.

The foregoing and the other objects of the present invention have been attained by providing an air-fuel ratio control apparatus for an internal combustion engine comprising an air-fuel ratio sensor to detect an air-fuel ratio in response to specified components contained in exhaust gas and an electronic control section which receives a signal from the air-fuel ratio sensor to calculate an amount of fuel to be injected from a fuel supplying device so that the air-fuel ratio of a gas mixture to be supplied to the engine approaches a target air-fuel ratio, wherein a parameter on a load for the engine and an engine revolution number are each detected by detecting means, and the electronic control section calculates a correction coefficient on the basis of the parameter of the load and the engine revolution number, whereby the output of the air-fuel ratio sensor is corrected, or an air-fuel ratio information obtained by the output of the air-fuel ratio sensor is corrected.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENT

Figure 1:
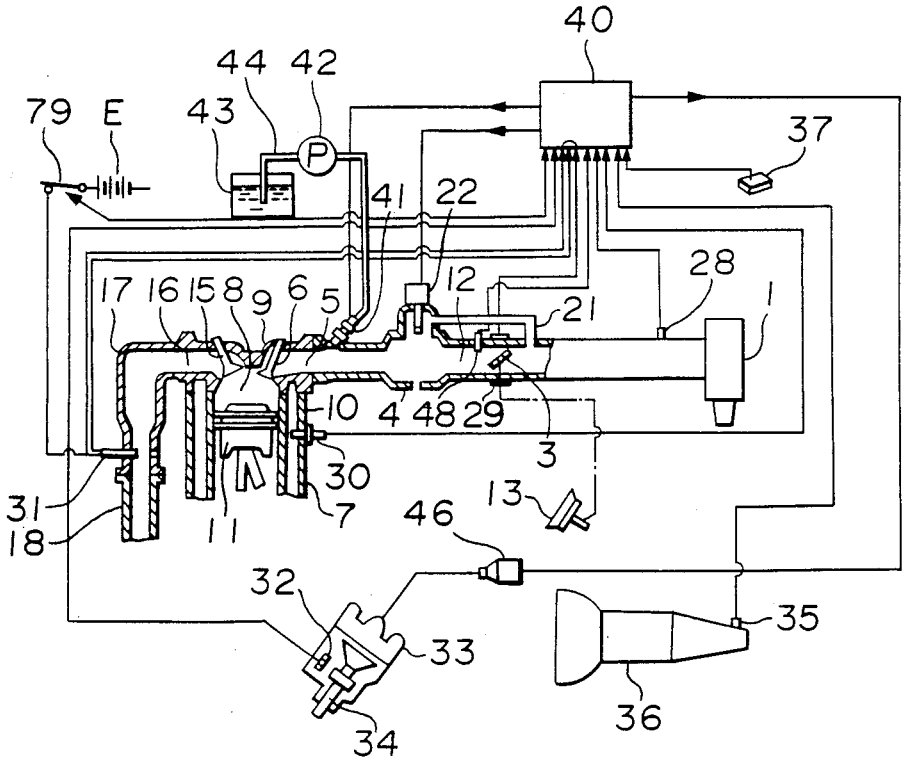
FIG. 1 is a systematic diagram showing an internal combustion engine for an automobile to which an embodiment of the air-fuel ratio control apparatus according to the present invention is applied.

Referring to the drawings, the same reference numerals designate the same or corresponding parts throughout the several views. Referring now to FIG. 1, there is shown a systematic diagram of an electronic-controlled fuel-injection-type internal combustion engine for an automobile to which the present invention is applicable.

In FIG. 1, air sucked through an air cleaner 1 is supplied to a combustion chamber 8 in the engine body 7 through an air intake passage 12 including a throttle valve 3, a surge tank 4, air intake port 5 and an intake valve 6.

A negative pressure sensor 48 is disposed in the air intake passage 12, and it is connected to an electronic control section 40.

A throttle valve 3 is operable in association with an acceleration pedal 13 in a driver's compartment. The combustion chamber 8 is defined by a cylinder head 9, a cylinder block 10 and a piston 11. Exhaust gas produced by firing a gas mixture is discharged to the atmosphere through an exhaust valve 15, an exhaust port 16, an exhaust branch pipe 17 and an exhaust pipe 18.

A by-pass conduit 21 connects the upper stream side of the throttle valve 3 to the surge tank 4, and a by-pass flow control valve 22 controls a cross-sectional area in the by-pass conduit 21 to thereby maintain a constant revolution speed of engine at the idling time.

An intake air temperature sensor 28 is disposed in the air intake passage 12 to detect the temperature of intake air, and a throttle position sensor 29 detects the degree of opening of the throttle valve 3.

A water temperature sensor 30 is attached to the cylinder block 10 to detect the temperature of cooling water. An air-fuel ratio sensor 31 is attached to the collecting portion in the exhaust gas branch pipe 17 to detect an air-fuel ratio at the collecting portion, and it is also connected to a battery E through a switch 79. The switch 79 is controlled by the electronic control section to be opened and closed. A crank angle sensor and an engine revolution detecting sensor 32 are adapted to detect a crank angle of a crank shaft (not shown) of the engine main body 7 and the number of revolution of the crank shaft on the basis of the revolution of the shaft 34 of a distributor 33 which is connected to the crank shaft.

A gear position sensor 35 on a speed change gear 36 detects a position of transmission, e.g. a neutral position or a driving position.

Outputs from the various detecting means such as the intake air temperature sensor 28, the throttle position sensor 29, the water temperature sensor 30, the air-fuel ratio sensor 31, the crank angle sensor, the engine revolution detecting sensor 32 and the gear position sensor 35 and a voltage signal from the battery 37 are supplied to the electronic control section 40.

Fuel injection valves 41, which constitute a fuel supplying device as a whole, are respectively provided near the intake ports 5 in correspondence to the cylinders and a pump 42 supplys fuel from a fuel tank 43 to the fuel injection valves 41 through a fuel conduit 44.

The electronic control section 40 receives input signals as parameters from the various sensors to calculate a quantity of fuel to be injected from each of the fuel injection valves 41, and supplys pulse signals having a pulse width corresponding to the calculated quantity of fuel to be injected to the fuel injection valves 41. The fuel injection valves 41 are opened in response to the pulse width to inject fuel.

The electronic control section 40 controls the by-pass flow control valve 22 and ignition coils 46. The secondary side of each of the ignition coils 46 is connected to the distributor 33.

FIG. 1 shows a D-J type fuel injection system for an electronic-controlled fuel-injection-type internal combustion engine, in which a basic injection pulse time is calculated on the basis of the output values of at least one of the negative pressure sensor 48 and the engine revolution detecting sensor 32, the basic injection pulse time is subjected to correction by a signal from the intake air temperature sensor 28, correction by a transient phenomenon and correction by a feed-back signal from the air-fuel ratio sensor, whereby a fuel injection quantity to the fuel injection valves 41 is determined.

Figure 2:
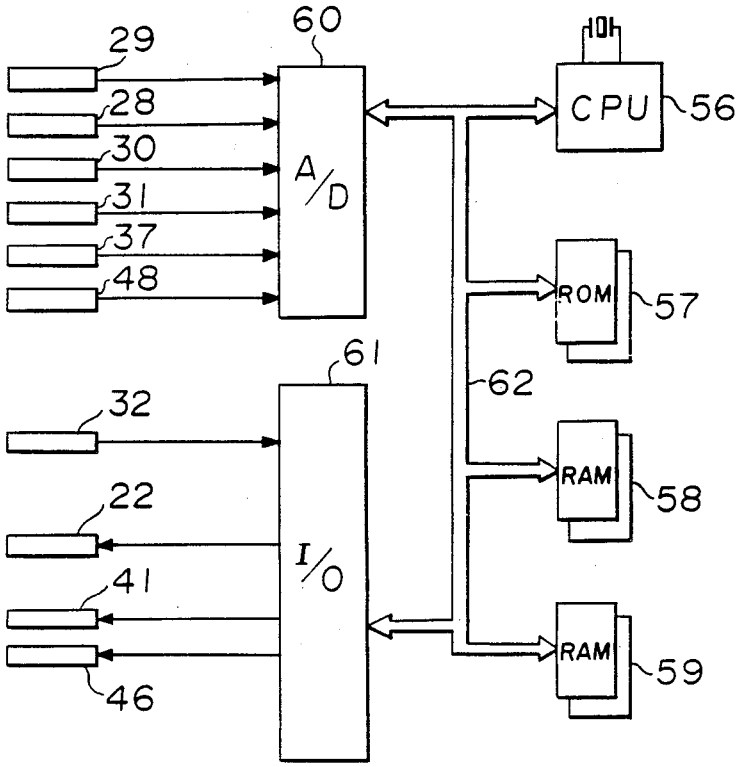
FIG. 2 is a block diagram showing an electronic control section used for an air-fuel ratio control apparatus in the internal combustion engine in FIG. 1.

FIG. 2 is a block diagram showing the construction of the electronic control section 40 in more detail. The electronic control section 40 is constituted by a micro processor which comprises a central processing unit (CPU) 56 for effecting calculation and control, a read-only memory (ROM) 57 which stores a program for correction routine (described later) and a program for by-pass flow controlling routine and other programs, a random-access memory (RAM) 58 for temporary storing data and a second RAM 59 (acting as an involatile memory device adapted to receive power from an auxiliary power source even at the time of stop of the engine and to store data essential to operate the electronic control section), an analogue/digital (A/D) transducer 60, an input/output (I/O) device 61 and a bus 62 connecting these elements.

The outputs of the throttle position sensor 29, the intake air temperature sensor 28, the water temperature sensor 30, the air-fuel ratio sensor 31, the battery 37, and the negative pressure sensor 48 are supplied to the A/D transducer 60.

The outputs of the crank angle sensor and the engine revolution sensor 32 are supplied to the I/O device 61. On the other hand, the by-pass flow control valve 22, the fuel injection valves 41 and the ignition coils 46 receive an input signal from the CPU 56 through the I/O device 61.

In the following, explanation will be made as to an example where an output value from the air-fuel ratio sensor or an air-fuel ratio information obtained by the above-mentioned output value is corrected, and the fuel supplying device is controlled so that there is obtainable a target air-fuel ratio on the basis of the corrected air-fuel ratio information. A program for the above-mentioned process is stored in the ROM 57.

Figure 3:
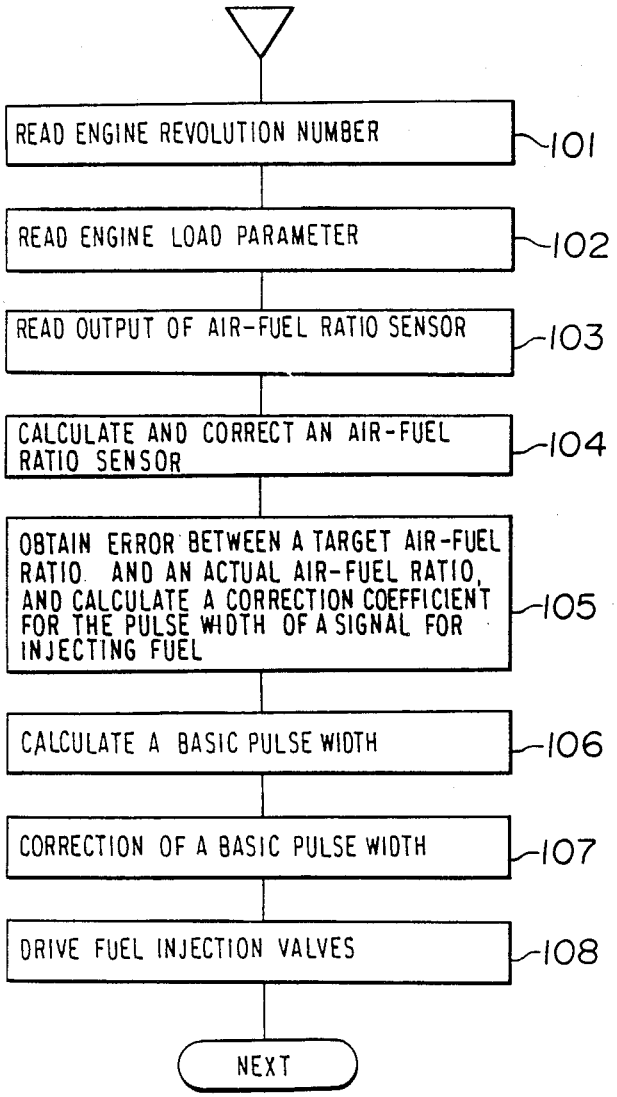
FIGS. 3 and 4 are respectively flow charts showing an embodiment of the operation for carrying out an air-fuel ratio control by the electronic control section shown in FIG. 2.

FIG. 3 is a flow chart for effecting the above-mentioned process. Namely, the electronic control section 40 reads the revolution number of the engine (Step 101), a parameter of load of the engine such as a negative pressure in an intake air pipe (Step 102) and an output from the air-fuel ratio sensor 31 (Step 103), respectively.

Figure 4:
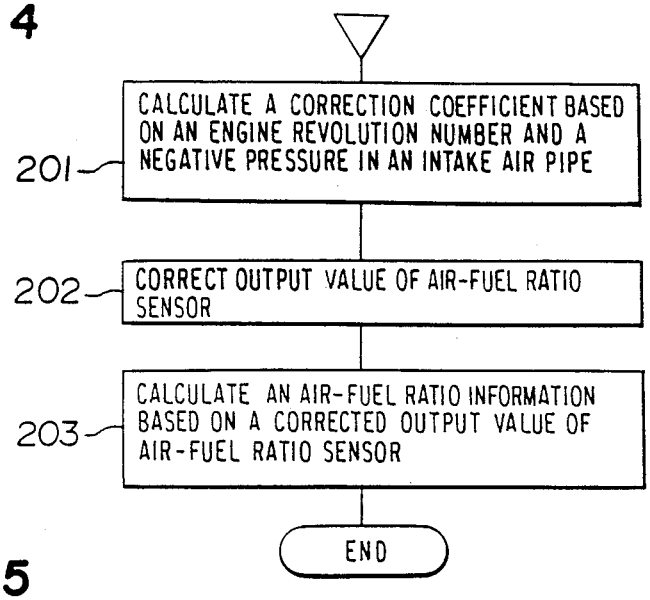

Then, correction of an operational condition is carried out on the basis of the engine revolution number and the parameter of the load of engine and thereafter, an air-fuel ratio information is obtained by calculation (Step 104). FIG. 4 shows the detail of the calculation of the above-mentioned parameters.

Figure 5:
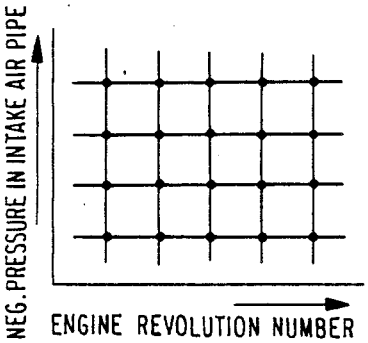
FIG. 5 is a graphical representation showing a relation of the revolution of an engine v.s. a negative pressure in the intake air pipe, which is used for calculating a correction coefficient depending on the operational conditions of the engine.

At Step 201, a correction coefficient of an operational condition is obtained based on the engine, revolution number and the parameter of the load of the engine. In obtaining the correction coefficient, a map having the coordinate of the engine revolution number and a negative pressure in intake air pipe as shown in FIG. 5 may be used. In the map data, a correction coefficient in correspondence to a revolution number and a negative pressure at the instant time can be obtained.

Figure 6:
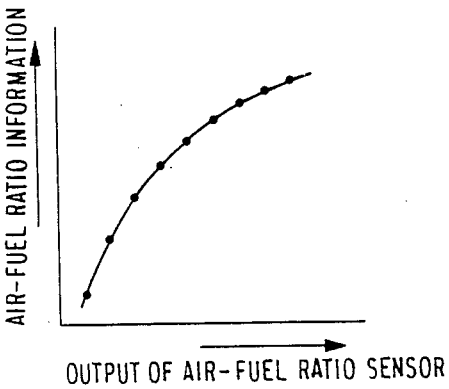
FIG. 6 is a graphical representation showing a relation of outputs from an air-fuel ratio sensor v.s. air fuel ratio information which is used for calculating the air-fuel ratio information.

At Step 202, the value of an output from the air-fuel sensor is corrected by using the selected correction coefficient. At Step 203, an air-fuel ratio information is calculated on the basis of the corrected output value of the air-fuel ratio sensor. In the calculation, a map as shown in FIG. 6 may be used in which an air-fuel ratio information corresponding to an output from the air-fuel ratio sensor is selected.

Returning to the flow chart in FIG. 3, an error is calculated by comparing a target air-fuel ratio obtained with reference to the air-fuel ratio information calculated at Step 104 with an actual air-fuel ratio, and a correction coefficient is calculated to reduce the error (Step 105).

At Step 106, a basic pulse width of a signal for fuel supply is calculated on the basis of the engine revolution number and the load in the intake air pipe. The basic pulse width is corrected by the correction coefficient obtained by calculating the error between the target air-fuel ratio and the actual air-fuel ratio, a basic fuel correction coefficient corrected by an output signal from the intake air temperature sensor 28 and so on (Step 107), and then the fuel injection valves 41 are opened on the basis of the corrected pulse width so that a predetermined amount of fuel is supplied to the engine (Step 108).

In the explanation with reference to FIG. 4, correction is made as to an output value from the air-fuel ratio sensor. However, the same effect can be obtained by correcting an air-fuel ratio information calculated by using the output of the air-fuel ratio sensor.

Further, the same effect can be obtained by using as a parameter of the load of engine, a signal from the throttle position sensor instead of the negative pressure in the intake air pipe. Furthermore, the same effect can be obtained by using intake air per unit revolution (Q/N) in the so-called L-J type fuel injection system wherein an amount of air directly sucked is measured, instead of use of the negative pressure in the intake air pipe.

Thus, in the present invention, a correct air-fuel information can always be obtained even when the conditions of exhaust gas vary depending on an operational condition of the engine and a highly accurate air-fuel ratio control is attained.

Obviously, numerous modifications and variations of the present invention are possible in light of the above teachings. It is therefore to be understood that within the scope of the appended claims, the invention may be practiced otherwise than as specifically described herein.

What is claimed is:

1. An air-fuel ratio control apparatus for an internal combustion engine comprising:

an air-fuel ratio sensor to detect an air-fuel ratio in response to specified components contained in an exhaust gas; and an electronic control section which receives a signal from said air-fuel ratio sensor to calculate an amount of fuel to be injected from a fuel supplying device so that the air-fuel ratio of a gas mixture to be supplied to the engine approaches a target air-fuel ratio;

correction coefficient means for permanently storing predetermined correction coefficients on a basis of values of a parameter of the load and the engine revolution number, said predetermined correction coefficients being usable for correcting at least one of the output of said air-fuel ratio sensor and an air-fuel ratio information;

data obtaining means for obtaining a parameter of a load for said engine and an engine revolution number by detecting means, and obtaining a correction coefficient from said correction coefficient means on the basis of the parameter of the load and the engine revolution number;

correcting means for using said obtained correction coefficient to correct at least one of the output of said air-fuel ratio sensor and an air-fuel ratio information obtained by the output of said air-fuel ratio sensor.

2. The air-fuel control apparatus according to claim 1, wherein said parameter of the load of engine is a negative pressure in the intake air pipe.

3. The air-fuel control apparatus according to claim 1, wherein said correction coefficient is obtained from a map having the coordinates of the parameter of the load of engine and the engine revolution number.

4. The air-fuel control apparatus according to claim 1, wherein said air-fuel ratio information is obtained by a relation of the output of said air-fuel ratio sensor to said correction coefficient.

* * * * *